US006425204B1

(12) United States Patent
Renner

(10) Patent No.: US 6,425,204 B1
(45) Date of Patent: Jul. 30, 2002

(54) WINDOW LIFTER WITH A GUIDE RAIL AFFIXED ON A BASE PART

(75) Inventor: Wolfgang Renner, Meeder (DE)

(73) Assignee: Brose Fahrzeugteile GmbH & Co. KG, Coburg (DE)

( * ) Notice: Subject to any disclaimer, the term of this patent is extended or adjusted under 35 U.S.C. 154(b) by 0 days.

(21) Appl. No.: 09/636,446

(22) Filed: Aug. 11, 2000

(30) Foreign Application Priority Data

Aug. 13, 1999 (DE) ..... 199 39 655

(51) Int. Cl.[7] ..... E05D 15/10
(52) U.S. Cl. ..... 49/213; 49/348; 49/352
(58) Field of Search ..... 49/213, 314, 375, 49/348, 349, 352, 502, 452

(56) References Cited

U.S. PATENT DOCUMENTS 3,844,064 A * 10/1974 Yamaha et al. ..... 49/348
4,094,100 A * 6/1978 Fukumoto et al. ..... 49/348
4,633,613 A * 1/1987 Kobayashi et al. ..... 49/352 X
4,658,546 A * 4/1987 Moriyama ..... 49/352
4,747,232 A * 5/1988 Stephenson et al. ..... 49/452
4,794,733 A * 1/1989 Kanemaru ..... 49/375 X
5,430,976 A * 7/1995 Wirsing ..... 49/452
5,784,832 A * 7/1998 LeeVan ..... 49/352
5,960,588 A 10/1999 Wurm et al. ..... 49/352
6,170,197 B1 * 1/2001 Tyves et al. ..... 49/375

FOREIGN PATENT DOCUMENTS

DE 196 11 074 9/1997
JP 6137023 * 5/1994 ..... 49/375

* cited by examiner

*Primary Examiner*—Jerry Redman
(74) *Attorney, Agent, or Firm*—Christie, Parker & Hale, LLP

(57) ABSTRACT

The invention concerns a window lifter with a guide rail (10) affixed on a base part (20) on a door inner panel, of an assembly carrier. The object of the invention is to provide a window lifter which is simple to adjust and prevents stressing of the window lifter system. This object is accomplished in that a seat (30) is formed on the base part (20), which seat is associated with a correspondingly shaped mating part (300) arranged on the guide rail (10), whereby the seat (30) and the mating part (300) are designed form-fittingly such that the guide rail (10) and the base part (20) are mounted tiltable relative to each other.

20 Claims, 3 Drawing Sheets

WINDOW LIFTER WITH A GUIDE RAIL AFFIXED ON A BASE PART

BACKGROUND OF THE INVENTION

The invention concerns a window lifter with a guide rail affixed on a base part.

It is generally known to affix guide rails of a window lifter, in which rails the window pane is driven along its closing and opening movement, on a base part. The base part is usually designed as a door inner panel or an assembly carrier. The guide rails are screwed, riveted, or welded or attached by snap elements to this base part. The guide rails rest on the base part with a flat face.

Disadvantageous in such connections is the fact that because of the fixed mounting of the guide rails on the base part, subsequent alignment of the guide rails is not possible, such that stresses may develop inside the window lifter system.

From DE 196 11 074 A1, an arrangement for the adjustment of a frameless window pane by a tilting motion at right angles to the longitudinal axis of the motor vehicle is known, wherein separate adjustment and locking means are provided for each guide rail. One of the guide rails is equipped with a slotted guide and the other guide rail has an adjustment screw, which is equipped with a self-locking thread. The guide rail with the slotted guide is first affixed loosely on the base part. By rotation of the adjustment screw, the guide rail is pivoted at a right angle to the longitudinal axis, and this rotational movement is transferred by the window pane to the guide rail with the slotted guide such that the position of the two guide rails as well as the window pane changes uniformly.

Such an arrangement does enable the adjustment of the window pane by a tilting motion; however, the coordination of the guide rail seat with the base part is only imprecisely possible since the two assemblies are placed only loosely on each other. Stresses due, for example, to twisting guide rails because of manufacturing inaccuracies cannot be compensated by this type of attachment or adjustment. Likewise, an adjustment of the guide rails with spherically curved window panes is difficult.

SUMMARY OF THE INVENTION

The object of the invention is to provide a window lifter with a guide rail affixed on a base part, which is simple and precise to adjust and which prevents stressing of the window lifter system.

The design of the seat and a corresponding mating part enables tilting without the guide rail and the base part being able to be displaced relative to each other. On the one hand, this makes possible the adjustability of the guide rail for exact, problem-free operation of the window lifter, since a specific affixing of the window pane has already occurred; on the other, no unwanted tilting or displacement of the rail occurs such that, overall, assembly accuracy is increased and assembly time is reduced.

An improvement of the invention provides that the seat and the mating part prevent displacement of the base part and the guide rail relative to each other in at least one direction, for example, by means of a cylindrical design of the seat and of the mating part, whereby the seat and mating part oppose each other in a mirror image. Thus, unwanted tilting around a specific axis can be prevented, whereby the accuracy of the assembly is rendered easier in those cases in which no adjustment around multiple axes must be made.

Through connection of the guide rail with the base part by means of a ball-cup mating it is possible to rotate the guide rails of the window lifter in multiple directions such that an exact adjustment of the guide rails can occur and no stresses occur within the window lifter system. Especially in the case of highly curved window panes, adjustability in multiple directions, which is accomplished by means of a ball-cup mating of the guide rails with the base part, is necessary.

In one embodiment of the invention, at least one ball- or cup-shaped seat is arranged on the base part or on the guide rail. By means of this seat, the ball-cup mating is realized, and a movable connection between the guide rail and the base part is permitted. For technical production reasons, it is advantageous to design this seat in one piece on the base part, for example, by an appropriate shaping process, such as deep drawing or pressing. It is possible to produce the seat already at the time of production of the base part in a molding operation such as casting or injection molding.

In an advantageous embodiment, the seat is designed as a cup-shaped recess in a conical or spherical projection. Thus, a base for the cup-shaped recess is more or less formed, yielding a relatively large radius of motion of the component (base part or guide rail) with the cup-shaped recess relative to the ball-shaped mating part. The conical or spherical projection in which the cup-shaped recess is formed can be formed on either the base part or the guide rail. The projection can likewise be formed in the guide rail or the base part in a shaping or molding operation.

As an alternative to the ball shape of the seat, provision is made to design the seat and, accordingly, the mating part as a barrel-shaped or cylindrical shape, whereby the seat has the mirror-image shape of the mating part. The adjustability of the guide rail can be realized with one of the mating pairs either through a combination of a ball-cup mating with a cylinder-mounting or by an adjustment arrangement on an attachment region of the guide rail, for example, by an adjustment bolt with a check nut.

Advantageously, a through-hole, through which an affixing means can be passed, is provided in the seat to enable an appropriate connection of the base part with the guide rail. The through-hole is formed either on the guide rail or on the base part and is advantageously provided as an oblong slot, thus yielding an increased adjustment range of the guide rail in the direction of the lengthwise path of the oblong slot. It is also possible to select the cross-section of the through-hole substantially larger than the cross-section of the affixing means such that there is increased movability of the guide rail relative to the base part in all directions. In the selection of the cross-section of the through-hole, consideration must be given to the fact that the guide rail is attached to the base part by the affixing means.

By designing the affixing means as a releasable connecting element, for example, as a screw, simple adjustment of the position of the guide rails relative to the base part is possible. Likewise, this makes it possible to perform subsequent adjustment or, in the event of repair or damage to the window lifter system, readjustment of the guide rails.

In an advantageous embodiment, the affixing means has a contact zone adjacent the base part and a contact zone adjacent the guide rail, whereby the respective contact zones are designed corresponding to the seat of the base part or of the guide rail. If, for example, the base part is designed flat, the corresponding contact zone is also designed flat. With a ball-shaped design of the base part or of the guide rail, the contact zone is, accordingly, cup-shaped to accommodate the ball-shaped zone of the guide rail or of the base part. The contact zones are shaped such that the guide rails can swivel relative to the base part.

In one embodiment of the invention, the affixing means is designed as an affixing screw which is connected only by at least an affixing nut with the base part and the guide rail. It is advantageous in this case if the affixing nut has a ball- or cup-shaped head corresponding to the seat of the base part or of the guide rail. This ensures that the head of the affixing nut comes into full-surface connection with the correspondingly shaped seat.

In a variant of the invention, the affixing means is nonreleasably connected with the guide rail, for example, by welding, soldering, or by extrusion. This reduces the number of parts that are necessary to affix or assemble the guide rail to the base part. In an improvement of the invention, the affixing means is designed as a threaded segment on which a curved contact zone is connected. This contact zone serves as a ball- or cup-shaped seat and enables an appropriate displacement of the correspondingly designed mating part. Provision is made, for example, to design the contact zone ball-shaped on the guide rail and to realize a cup-shaped seat of the base part such that the guide rail and the base part can the swivel in multiple planes.

Provision is further made that the mating part and the affixing means form one assembly unit such that the mating part does not have to be designed in one part in the guide rail, but instead can be produced and mounted separately, for example, as a special screw. This is especially advantageous if the mating part must have special hardness and thus must be made from a different material.

BRIEF DESCRIPTION OF THE DRAWINGS

Exemplary embodiments of the invention are explained in the following with reference to the figures. They depict.

DETAILED DESCRIPTION OF THE INVENTION

Figure 1:
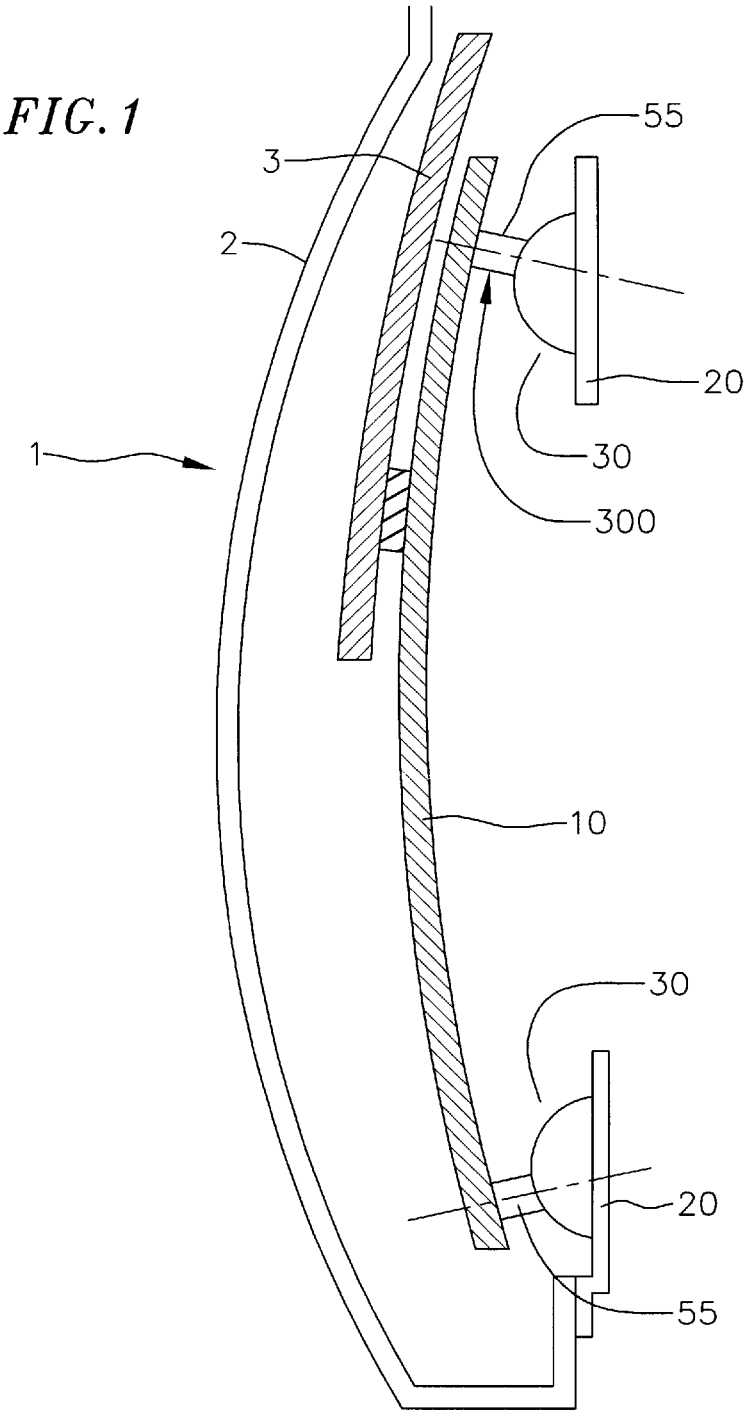
FIG. 1 a cross-sectional depiction through a motor vehicle door.
Figure 7:
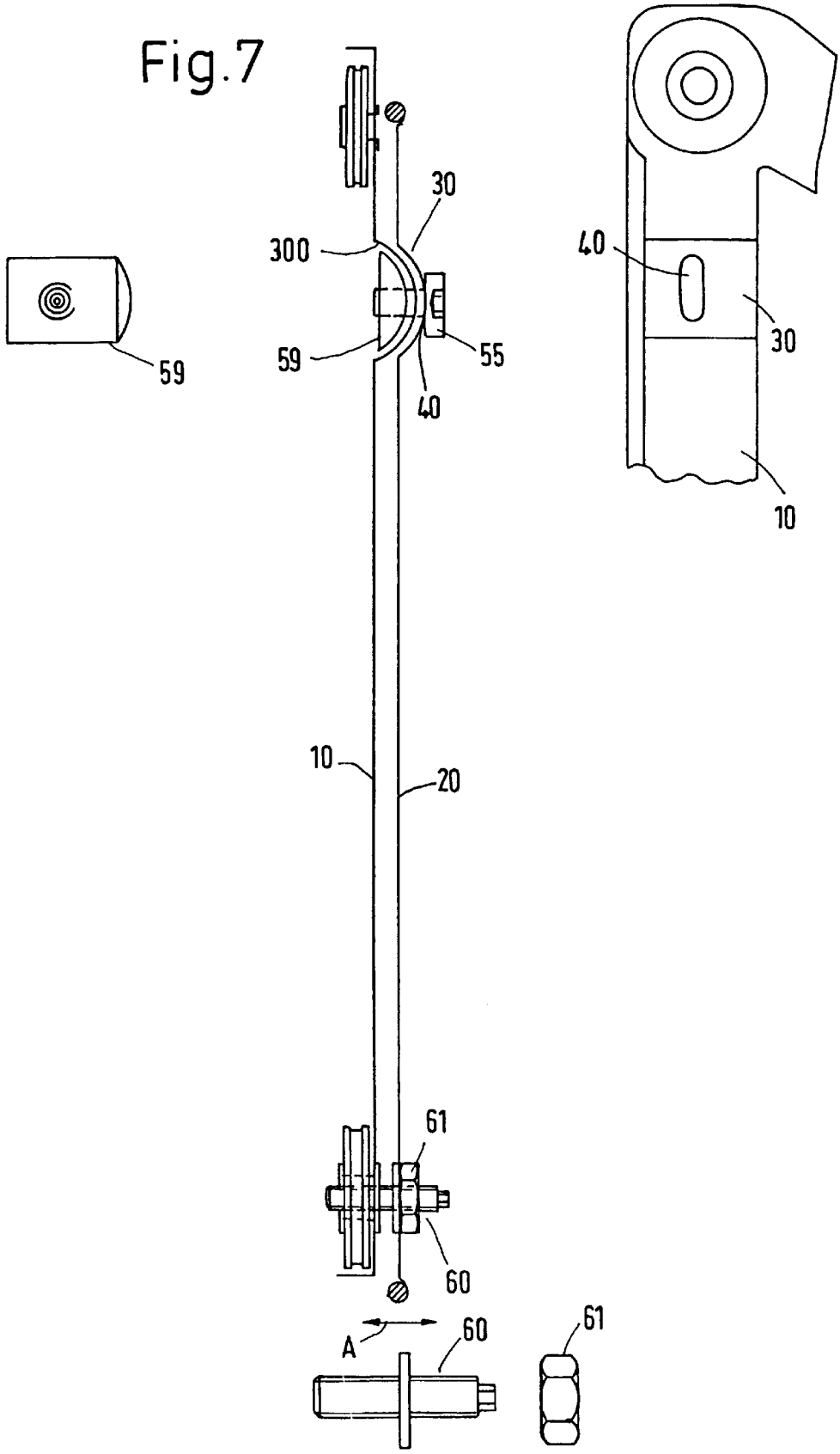

FIG. 1 depicts a motor vehicle door 1 with an exterior panel 2 and a base part 20, whereby the base part is designed as a door inner panel. In the cavity formed by the exterior panel 2 and the door inner panel 20, a window pane 3 is mounted displaceable along the guide rail 10. The drive of the window pane 3 to adjust the position is not shown. The guide rail 10 is connected to the door inner panel 20 by a ball-cup mating, whereby a spherical seat 30, which is connected to the guide rail 10 by means of an affixing means 55, is designed on the door inner panel 20. The affixing means 55 is designed as an affixing screw and is affixed both to the guide rail 10 and to the seat 30 of the door inner panel 20. In this embodiment the affixing means forms a mating part 300 with the seat 30 and they form a functional unit. FIG. 7 depicts and explains a different embodiment of the mating part.

Figure 2:
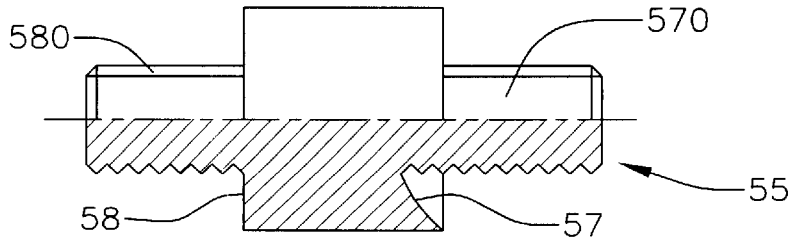
FIG. 2 an affixing screw in partial cross-section.

One example of such an affixing screw 55 is depicted in FIG. 2, in which an affixing screw 55 with a threaded segment 570, on which a contact zone 57 is connected, which is designed corresponding to the curve of the seat 30, is depicted. The threaded segment 570 is inserted through a through-hole 40 of the seat 30, as depicted cross-sectionally in FIG. 3. The through-hole 40 may be designed either as an oblong slot to permit an increased radius of movement in one direction, or have a larger cross-section in all directions than the cross-section of the threaded segment 570 such that movability of the affixing screw 55 on the surface of the seat 30 in all directions is enabled. Of course, the cross-section of the through-hole 40 is not larger than the cross-section of the contact zone 57, so that a connection does in fact occur.

Figure 3:
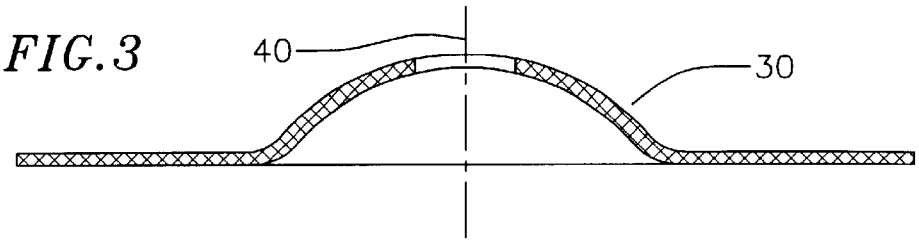
FIG. 3 a cross-sectional depiction through a seat.

As depicted in FIGS. 2 and 3, the curvature of both the seat 30 and contact zone 57 is cap-shaped such that movability in all directions is possible. However, it is also conceivable that the seat 30 have a barrel shape and the contact zone 57 be shaped accordingly.

Figure 4:
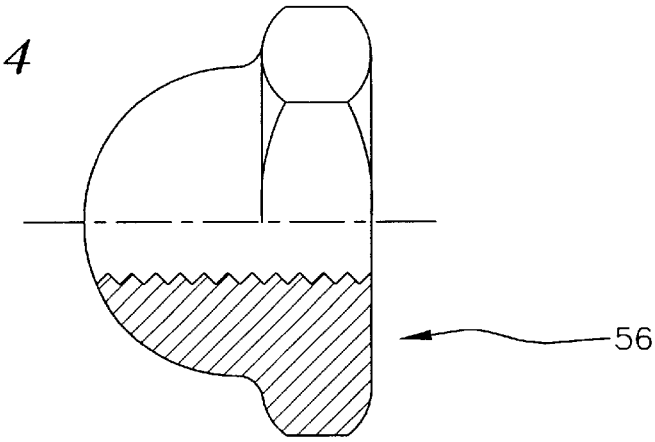
FIG. 4 an affixing nut in partial cross-section.

FIG. 4 depicts an affixing nut 56 which has a round head whose curve is designed to correspond with the curve of the seat 30 in FIG. 3. The installation of the affixing screw 55 occurs in that the threaded segment 570 is introduced from above through the through-hole 40 of the seat 30 according to FIG. 3 and is screwed on with the affixing nut 56 which is introduced into the seat 30 from below.

On the side of the affixing screw 55 turned away from the seat 30, an additional threaded segment 580 is provided, to which a contact zone 58 is adjacent, which comes into contact with a guide rail (not shown). The connection of the guide rail with the affixing screw 55 may be made either by means of a thread-nut connection, whereby the threaded segment 580 is pushed through a through-hole in the guide rail and screwed on with a separate nut, or the threaded segment 580 is screw directly into a thread incorporated into the guide rail and thus is attached directly to the guide rail.

An oblong slot or an enlarged diameter of a through-hole made also be provided on the guide rail itself to provide adequate play for adjustment of the position of the guide rail.

Of course, it is possible to produce the seat 30 along with the curve on the guide rail 10 and to design the base part 20 or the door inner panel or the assembly carrier flat. Likewise, it is possible to produce, on both sides of the affixing screw 55, appropriately shaped contact zones which have a curve corresponding to the respective seat of the guide rail or the base part.

Figure 5:
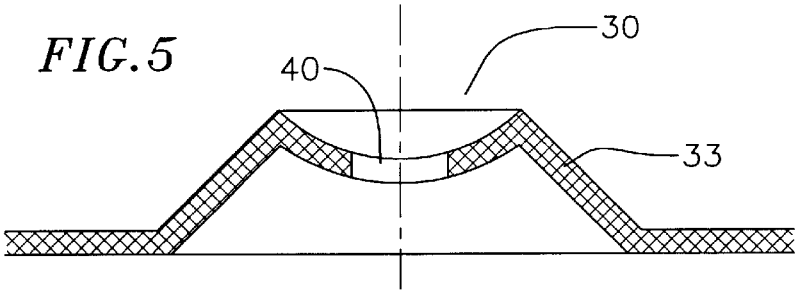
FIG. 5 a cross-sectional depiction through a seat in a ball-shaped projection.

In a variant of the invention, as depicted in FIG. 5, the seat 30 is designed as a cup-shaped recess in a conical or truncated ball-shaped projection 33. An enlarged, unobstructed space is formed between the guide rail and the base part by means of the conical projection, thus increasing the degree of movability of the guide rail and the base part relative to each other. With such a conical or ball-shaped projection 33 with a seat 30 formed in it, it is possible to place the base part and the guide rail directly on each other. For example, the base part is equipped with a cup-shaped recess in a conical projection 33 and a ball-shaped seat is provided on the guide rail, and they are placed directly in each other. Through-holes 40, through which a standard threaded pin is passed, are provided in both the cup-shaped recess of the base part and in the ball-shaped seat 30. Affixing then occurs by screwing by means of affixing nuts, the heads of which are either ball-shaped, as depicted in FIG. 4, or cup-shaped. The through-holes 40 in the base part 20 and in the guide rail 10 may be designed as oblong slots which have a different orientation from the longitudinal direction. Thus, it is possible to adjust the guide rails in multiple planes.

Figure 6:
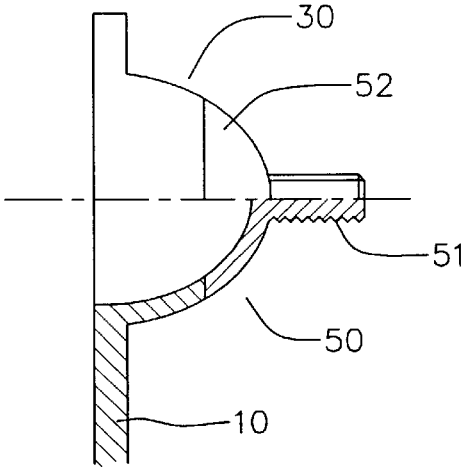
FIG. 6 a partial cross-sectional view of an affixing means nonreleasably connected to a guide rail, and FIG. 7 a cross-sectional depiction through a motor vehicle door with a cylindrical or barrel-shaped seat.

FIG. 6 depicts an alternative embodiment of the invention, in which the affixing means 50 is nonreleasably connected with the guide rail 10. The affixing means is designed here as a threaded segment 51 with a curved contact zone 52 and welded directly onto a curved projection or a passage through the guide rail 10 or nonreleasably connected with the guide rail 10 in some other manner. This produces a curved seat 30 which corresponds to a corresponding cup-shaped seat of the base part (not shown). The guide rail 10 thus preassembled can be mounted directly on the base part, which enables simplification of assembly.

Of course, it is also possible to connect the affixing means 50 with the base part 20 and to provide a cup-shaped seat on the guide rail.

FIG. 7 depicts a cross-section through a motor vehicle door with a base part 20 designed as a door module and a guide rail 10. A seat 30 in the form of a barrel-shaped or cylindrical recess is formed on the base part 20, in which recess a through-hole 40, through which an affixing means 55 is passed, is formed. On the guide rail 10, a mating part 300, shaped as a positive impression of the seat 30, is formed and is placed in the seat 30 for assembly of the motor vehicle door. In the example depicted, both the seat 30 and the mating part 300 are arranged or formed on the base part 20 on the upper affixing zone of the guide rail 10. For assembly of the guide rail 10 on the base part 20, these are placed on top of each other such that the seat 30 and the mating part 300 lie on top of each other, and then the guide rail 10 is mounted initially still tiltable around one axis but immovable relative to each other by means of an affixing means 55 designed as a screw and a sliding block 59. In the case of a motor vehicle side door, the tilting axis is essentially parallel to the direction of travel, in rear doors accordingly perpendicular thereto. Thus, adjustability of the guide rail 10 is obtained in the so-called y-direction, which is usually essential with curved window panes, and unwanted tilting motions around the longitudinal axis of the guide rail 10 are securely braced and prevented by the barrel-shaped or cylindrical design of the seat 30 or the mating part 300.

An adjustment bolt 60, which can be set in various positions on the base part 20 by means of a check nut 60, is affixed in the lower affixing zone of the guide rail 10, which is indicated by the arrow A. This defines the degree of angular displacement simply and reliably. As soon as the correct adjustment of the guide rail 10 to the base part 20 has been made, the screw 55 is tightened accordingly and the sliding block 59 provided with a thread also defines the upper affixing zone.

Especially for stress-free affixing of nonadjustable panes, provision is made that a cylinder-cup combination is arranged in the upper affixing zone and a ball-cup combination is arranged in the lower affixing zone such that the corresponding displacement around the respective axes is possible. At least one of the affixing points is equipped with the seat 30 and its mating part 300 according to the invention; of course, different combinations of the seats or mating parts may be used.

What is claimed is:

1. A window lifter assembly for lifting a window pane in an automobile door body, comprising:

a guide rail having a first side and a second side, the guide rail to guide the window pane along the first side of the guide rail;

a base part attached to the guide rail on the second side of the guide rail;

a seat on the base part and a mating part on the guide rail, the mating part having a shape that corresponds form-fittingly to the shape of the seat; and wherein the guide rail and the base part are mounted tiltable relative to each other.

2. The window lifter assembly according to claim 1 wherein the seat and the mating part prevent displacement of the base part and guide rail relative to each other in at least one direction.

3. The window lifter assembly according to claim 1 or 2 wherein the guide rail is connected to the base part by a ball-cup mating.

4. The window lifter assembly according to claim 3 wherein the seat is one of cup-shaped and ball-shaped and the mating part is the other one of cup-shaped and ball-shaped.

5. The window lifter assembly according to claim 4; wherein the seat is formed in one piece with the base part.

6. The window lifter assembly according to claim 5 wherein the seat is a cup-shaped recess in a conical or ball-shaped projection.

7. The window lifter assembly according to claim 4 wherein the seat is a cup-shaped recess in a conical or ball-shaped projection.

8. The window lifter assembly according to claim 1 or 2 wherein the seat and the mating part are one of barrel-shaped and cylindrical, and the seat forms the mirror-image shape or the mating part.

9. The window lifter assembly according to claim 1 wherein the seat has a through-hole for installation of an affixing means.

10. The window lifter assembly according to claim 9 wherein the through-hole is an oblong slot.

11. The window lifter assembly according to claim 1, further comprising an affixing means, wherein the affixing means is a releasable connecting element.

12. The window lifter assembly according to claim 11 wherein the affixing means has a first contact zone adjacent to the base part and a second contact zone adjacent to the guide rail; and the shape of the first contact zone corresponds to the seat of the base part and the shape of the second contact zone corresponds to the guide rail.

13. The window lifter assembly according to claim 1 further comprising an affixing means, wherein the affixing means is nonreleasably connected with one of the guide rail and the base part.

14. The window lifter assembly according to claim 1 further comprising an affixing means, wherein the mating part and the affixing means form a single assembly.

15. The window lifter assembly according to claim 1, wherein the base part is one of a door inner panel and an assembly carrier.

16. The window lifter of claim 1 wherein the guide rail has a through-hole in the shape of an oblong slot.

17. A window lifter assembly for an automobile door comprising:

a base part coupled to the automobile door, the base part having a seat;

a guide rail attached on the base part by an affixing means such that the base part supports the guide rail when assembled to the door, at least one of the guide rail and the affixing means having a mating part, the mating part having a shape that corresponds form-fittingly to the shape of the seat;

wherein the guide rail and the base part are mounted tiltable relative to each other; and, wherein the affixing means is an affixing screw, which is connected with the base part and the guide rail by at least one affixing nut.

18. The window lifter assembly according to claim 17 wherein the affixing nut has a shaped head corresponding to one of the seat and the mating part.

19. A window lifter assembly for an automobile door comprising:

a base part coupled to the automobile door, the base part having a seat;

a guide rail attached on the base part by an affixing means such that the base part supports the guide rail when assembled to the door, at least one of the guide rail and the affixing means having a mating part, the mating part having a shape that corresponds form-fittingly to the shape of the seat;

wherein the guide rail and the base part are mounted tiltable relative to each other; and, wherein the affixing means is a threaded segment with a curved contact zone.

20. The window lifter assembly according to claim 19 wherein the curved contact zone is one of cup-shaped and barrel-shaped and corresponds with one of the seat of the base part and the mating part of the guide rail (10).

* * * * *

UNITED STATES PATENT AND TRADEMARK OFFICE

CERTIFICATE OF CORRECTION

PATENT NO. : 6,425,204 B1
DATED : July 30, 2002
INVENTOR(S) : Wolfgang Renner

It is certified that error appears in the above-identified patent and that said Letters Patent is hereby corrected as shown below:

Title page,
Item [57], ABSTRACT,
Line 2, replace "on a door inner panel, of an assembly carrier." with -- in the form of a door inner panel, an assembly carrier, or the like. --.

Column 6,
Line 17, replace "claim 4;" with -- claim 4 --.
Line 27, replace "or" with -- of --.
Line 67, replace "and," with -- and --.

Column 8,
Line 5, replace "and," with -- and --.

Signed and Sealed this

Twenty-fifth Day of March, 2003

JAMES E. ROGAN
*Director of the United States Patent and Trademark Office*